US007225932B2

(12) United States Patent
Gencer

(10) Patent No.: US 7,225,932 B2
(45) Date of Patent: Jun. 5, 2007

(54) SYSTEM UNITS FOR TREATMENT OF AGGREGATE MATERIAL

(76) Inventor: Mehmet Nezir Gencer, M.Fuat Kuscuoglu Cad, No:83, Bursa (TR)

( * ) Notice: Subject to any disclaimer, the term of this patent is extended or adjusted under 35 U.S.C. 154(b) by 0 days.

(21) Appl. No.: 10/510,664

(22) PCT Filed: Oct. 3, 2002

(86) PCT No.: PCT/TR02/00061

§ 371 (c)(1),
(2), (4) Date: Oct. 7, 2004

(87) PCT Pub. No.: WO03/085204

PCT Pub. Date: Oct. 16, 2003

(65) Prior Publication Data

US 2005/0128861 A1 Jun. 16, 2005

(30) Foreign Application Priority Data

Apr. 9, 2002 (TR) ..... 2002 00962

(51) Int. Cl.
*B07B 1/00* (2006.01)

(52) U.S. Cl. ..... 209/240; 209/241; 366/16

(58) Field of Classification Search ..... 209/240, 209/241, 243, 245, 246, 247, 256, 257, 258, 209/370, 372, 373, 242; 366/16, 41
See application file for complete search history.

(56) References Cited

U.S. PATENT DOCUMENTS

| | | | | | |
|---|---|---|---|---|---|
| 3,812,889 | A * | 5/1974 | Strehlow | 141/93 |
| 4,387,996 | A * | 6/1983 | Mendenhall | 366/4 |
| 4,579,458 | A * | 4/1986 | Ohlson | 366/8 |
| 4,993,839 | A * | 2/1991 | Brock | 366/7 |
| 5,215,372 | A * | 6/1993 | Milstead | 366/18 |
| 5,634,712 | A * | 6/1997 | Musil | 366/222 |

FOREIGN PATENT DOCUMENTS

FR 2358966 A * 3/1978

* cited by examiner

*Primary Examiner*—Joseph Rodriguez
(74) *Attorney, Agent, or Firm*—Robert L. Epstein; Epstein Drangel Bazerman & James LLP

(57) ABSTRACT

An aggregate storing and classifying mechanism for production of asphalt in plants, comprising a body (2) having plurality of circular sections (6) arranged in a manner of substantially surrounding the body (2) for storing aggregate material comprising different gradation levels plurality of foot means (1) holding said body (2); corridor means (7) and channel means (15) arranged tree branch-like manner in the body (2) for distributing and storing the aggregate in the body (2) as homogenously; plurality of discharge mouths (4) and discharge covers (8) for discharging the aggregate material from the body (2) and feeding the aggregate material to conveyors placed under the body (2) through plurality of discharging axis.

11 Claims, 12 Drawing Sheets

SYSTEM UNITS FOR TREATMENT OF AGGREGATE MATERIAL

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to production method and mechanism for the production of bituminous hot mix (asphalt) in plants where aggregate and micro granulated dust particles obtained from ballast material are used as raw material and collected within a closed system. In this system, aggregate materials are crushed and separated through to screens considering the requirement for their relative particle sizes and grades and deposited. Later aggregates are either transferred into the asphalt plant for continuous feeding of the system or taken directly for discharge.

2. Description of Prior Art Including Information

In order for better understanding of present invention, terms and definitions characteristic to this technical field are explained below:

Aggregate: Main raw material used in asphalt production, obtained through crushing of hard stone particles.

Bitumen: raw material obtained from petroleum, used to attach aggregates to each other.

Crusher Plant: Plant for crushing and sieving hard stone particles.

Asphalt Plant: Plant for asphalt production.

Asphalt: Material obtained from mixing of aggregate with bitumen, used especially for paving of roads and open spaces.

Gradation: Relative size of a stone particle in a graded series.

Ballast: Stone particles with 25–65 mm in size, they are crushed in primary crusher after extracted from stone quarry to be separated from other foreign particles.

Asphalt is obtained through several steps which involve the mixing of hot bitumen with specified sized of aggregates collected together according to their sizes and heated in controlled manner.

Figure 1:
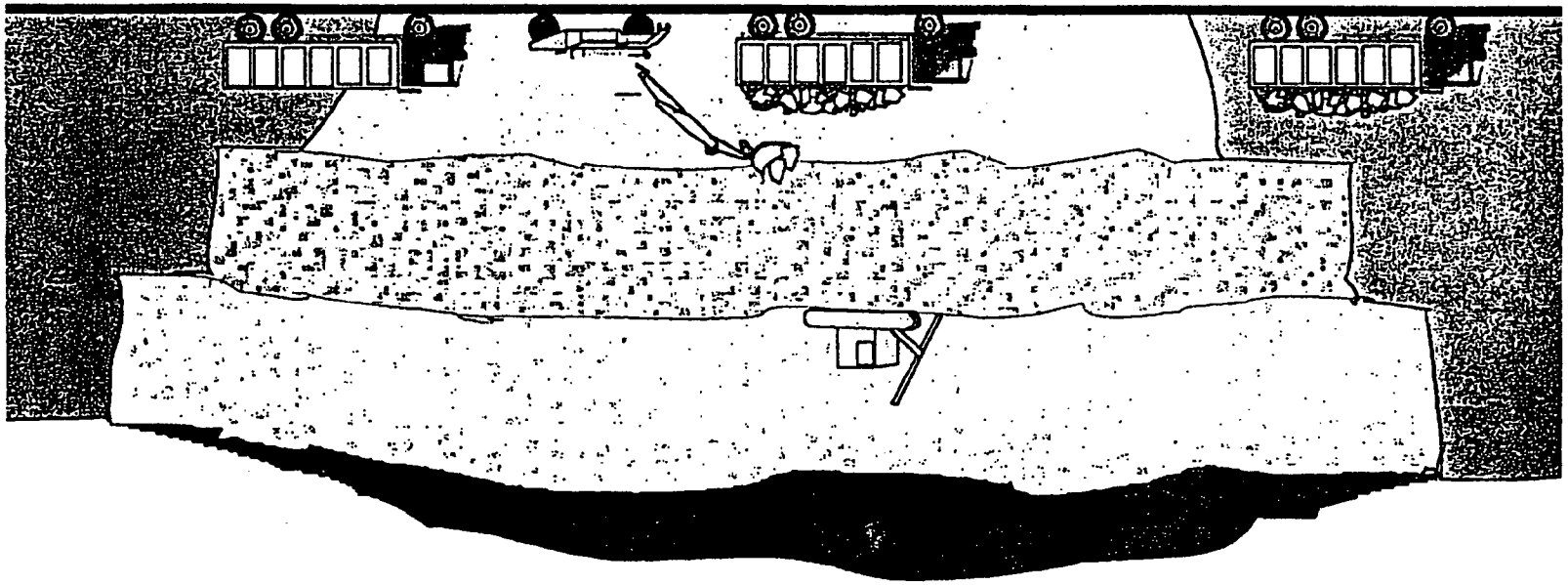

In FIG. 1, hard stones used in asphalt production are shown. They are obtained through dynamiting stone quarries, mines or river beads and transferred into crusher to unit. This material usually contains soil and large, coarse stone particles which are crushed with various crushing elements such as jaw crusher, impact crusher, hammer crusher etc. at two stages known as primary crushing and secondary crushing. This is shown in FIG. 2.

In order to produce aggregate, first soil material inside the crushed stone particles are roughly eliminated through bypass system later coarse stone particles go through crushing and sieving stages to produce aggregates at required sizes in crushing units which are arranged in horizontal fashion.

Figure 2:
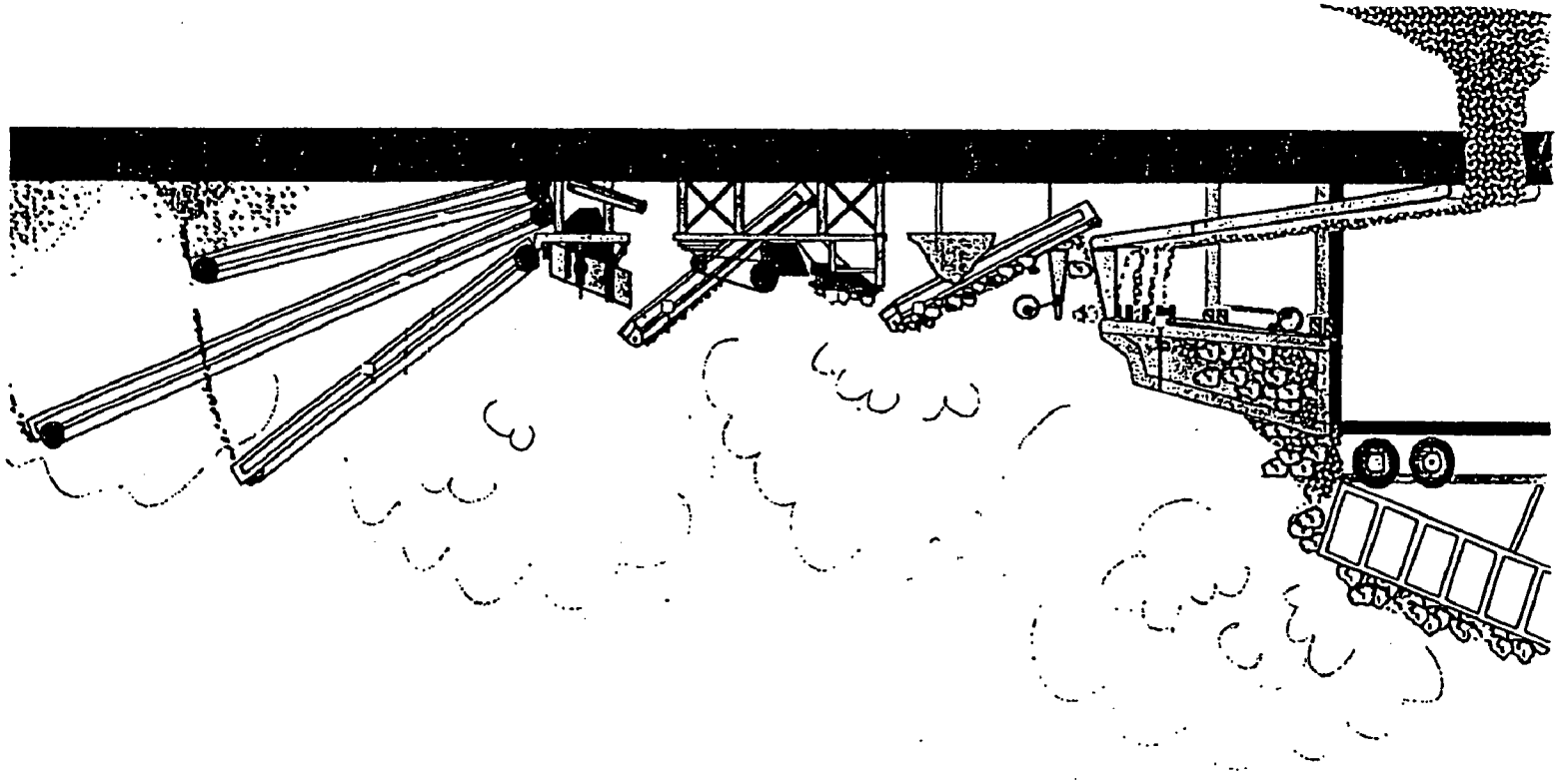

As it is seen in FIG. 2, crushing procedure is carried out at two sequential orders called primary crushing stage and secondary crushing stage. Transport and conveyance between these two stages are made with conveyors.

Large stone particles are almost reduced less than 150 mm in size in primary crushing whereas a further reduction in size which is almost less than 25 mm is get through secondary crushing.

Figure 3:
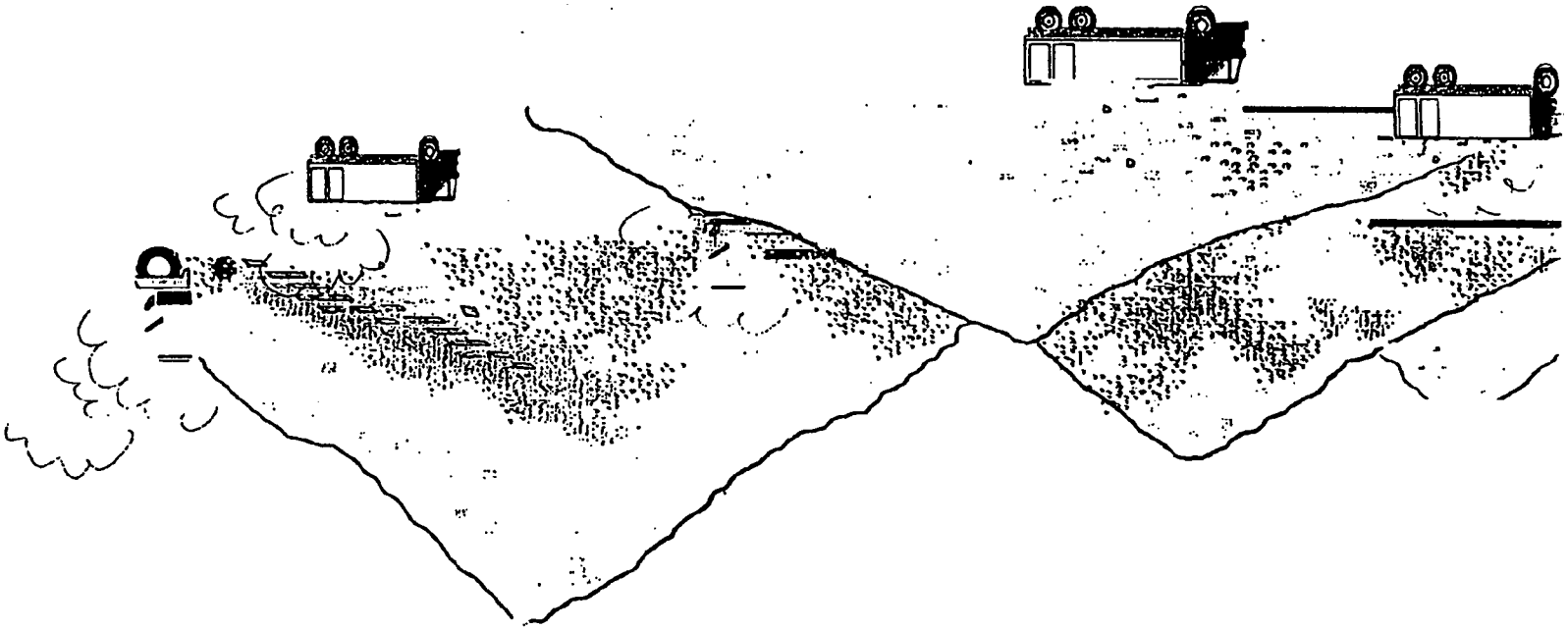
Figure 4:
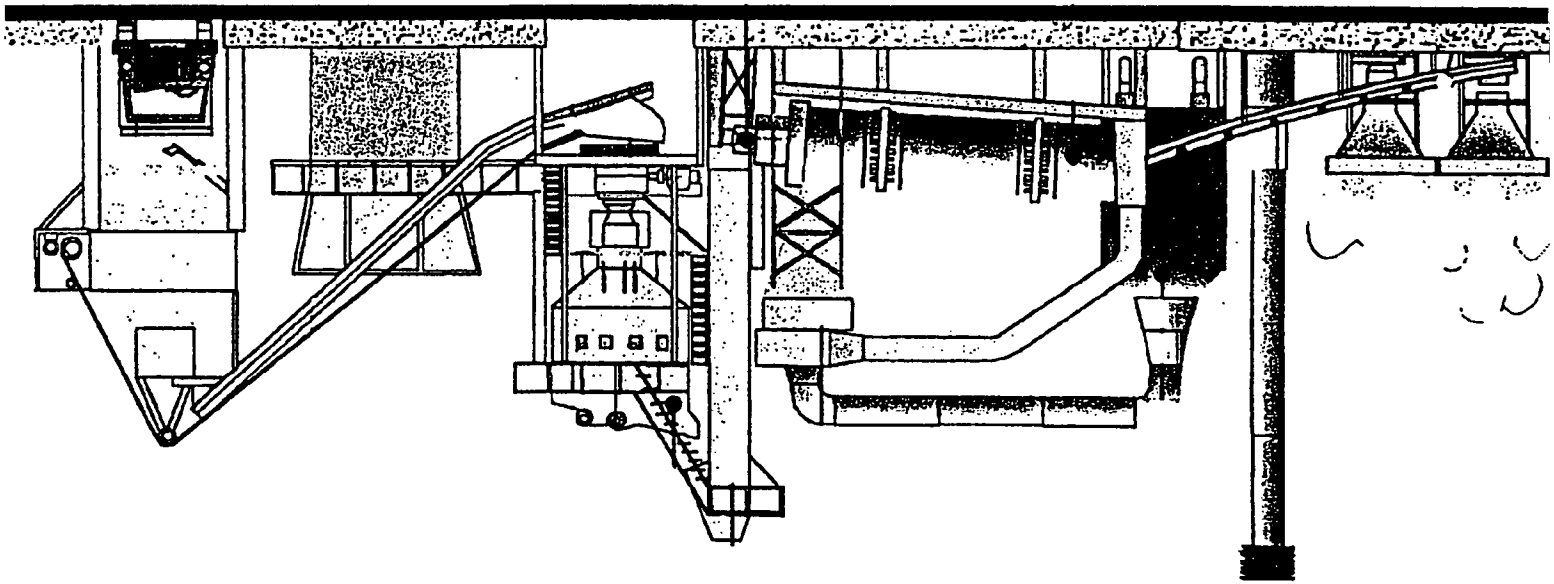

Crushed stones (aggregates) are classified according to their sizes by passing through screens at various sizes (FIG. 2) and these classified aggregates (for example classified between 0–4 mm, 4–7 mm, 7–12 mm and 12–19 mm) are stored at open areas as shown in FIG. 3 without allowing them to mix with each other. Each category of classified aggregates is then transferred to cold aggregate bunkers to be used as raw material for asphalt production. This is shown in FIG. 4.

Aggregates are transferred into conveyors (FIG. 4) via passing through feeders placed under bunkers and discharged into drying oven where aggregates are advanced inside the oven by a rotating motion and dried with the help of hot air and heated inner surface of dryer oven as a result of vaporization of water vapor inside aggregates. Temperature inside dryer is raised up to 160 C. Drying ovens are generally heated with burners which consumes fuel either in liquid or in gas forms. (FIG. 4)

Burned gases from drying oven are thrown out usually with an exhaust pipe after they have been initially treated with a high capacity dust retaining filter placed above the plant's exhaust system in order to prevent;

1. environmental pollution which is caused as a result of mixing and spreading of micro granulated dust particles inside aggregate and burned air inside dryer oven with water vapor and exhaust gases during emptying from pipe,
2. escape of dust particles which are important raw material for good quality asphalt production and to store them Dust particles are retained in cyclones of this filter system to be used as filler material. As shown in FIG. 4, this application is started to be widely used except some plant types.

Filler material collected in cyclone units are transferred into filler silo through the use of spiral conveyor (FIG. 4).

Aggregates heated and dried in dryer oven are transferred into asphalt plant through vertical elevator (FIG. 4). As it is seen in the figure, hot aggregates are passed through with multi-layered screen unit for further screening, classified according to their sizes and discharged into hot aggregate bunker.

Aggregates required for asphalt production at certain quantity and sizes are weighed automatically and transferred into mixer.

On the other side, bitumen which will also be used in asphalt production are automatically weighed in bitumen weighbridge and added into aggregate content inside the mixer.

Now, aggregates and bitumen which come together inside the mixer are thoroughly mixed during a definite time interval to obtain a homogenous bituminous hot mixture (FIG. 4).

Mixture obtained through this process are either directly discharged over carrying vehicle or stored in ready asphalt bunkers before carrying for use.

DISADVANTAGES OF THE PRESENT STATUS OF THE ART

Crusher Unit Settlement Area

Any crusher unit which will feed an average size asphalt plant having a production capacity of 2.000 ton per day should produce and store approximately 20.000 tons of aggregate only to meet the need for 10 days. Since the transfer of 20.000 tons of aggregate from stone quarry to crusher plant as well as the storage of aggregates may give rise to certain difficulties, crusher plants are usually established at open areas with close vicinity to stone quarries.

Crushing and sieving units of a crusher plant which are operated based on the current state of technical knowledge are constructed being integrated in a horizontal settlement order which one unit follows the other and material transfer between units are carried out with conveyors in the same plane (FIG. 2).

Storage Areas

As it may be comprehended from above explanations that the structural integrity which conforms to current state of technical knowledge and asphalt production processes initially require crushing of entire aggregates at all gradation levels and storage for further usage.

The main units of an asphalt plant are structurally large and wide in terms of mass and volume and they require a certain period of time to attain the required process conditions such as operation temperature. Therefore, an uninterrupted operation is what the manufacturer looks for after plant has been operated. On the other hand, a continuous plant operation depends on one important factor that is the presence of required quantity and sizes of aggregates at a proper time during operation in order to feed the plant continuously.

A continuous plant operation is however quite not practical yet unfeasible in terms of a coordination between plant and crusher unit providing a sustained material feed where at least in existing operating systems at which units are arranged horizontally according to open area system. Furthermore, complex structure of equipments, need for wide areas, high cost of investment and operation and full stop of whole system when a fault occurs make continuous operation impractical in the view of asphalt manufacturers.

Therefore, asphalt manufacturers tend to operate asphalt plant and crusher unit separately and store required amount of aggregate at all gradation levels prior to asphalt production. This high amount of aggregates is deposited at large storage areas until they are going to be used.

Another factor which makes storage inevitable is that the amount of aggregates obtained after crushing, sieving and classification do not meet the real aggregate amount required for asphalt production. Therefore, the amount of aggregates produced in a crusher unit are planned in order to meet the possible highest aggregate requirement. Also the uncontrollable distribution rates of different sized of aggregates renders the production of excess amount of aggregates necessary also the storage of finished aggregates in large and closed areas prior to asphalt production brings additional investment costs and difficult.

Aggregates which are classified in the best gradation level 0–4 mm. constitute about 50 $^{0}/0$ of total aggregate requirement for asphalt production. These aggregates which are usually stored at open areas uncovered are easily gone away due to wind effect. These size of aggregates which are easily blown (under 1 mm.) are the most important aggregate class for quality asphalt production. In case of under production of this aggregate class where production does not meet the requirement, supply through outside means is both troublesome and difficult.

To take necessary precautions to get rid of the wind effect such as being covered by a canvas sheet is not always possible in fact it is preferable not to cover aggregates to get benefit from heating effect of sunshine for drying aggregates. However, storage of aggregates at open areas may give rise to numerous unwanted effects which in turn spoil the quality of asphalt produced.

The Effect of Wind

During the determination of the area at which crusher unit will be settled, factors such as direction of dominating wind at the area should be considered as it will adversely effect both worker's health and environment due to spreading of dust particles around with the wind effect. A light wind in the area is always preferable. When no wind blows there, heavy dust arising during operation sinks over the units rendering crusher unit almost unworkable. Another negative factor which is due to wind effect is that when the area is exposed to heavy wind, dust particles are spread around and they are no longer usable as filler material which is required as an important input for asphalt production.

Some crusher plants use water pulverization method to wet aggregates as a means of subsiding dust in certain cases but the quality of asphalt produced using wet aggregates is affected unfavorably.

The Effect of Mixing with Foreign Particles

Maintenance the ground and surroundings of aggregate stock areas is not always easy. Aggregates usually mix with other foreign substances or fine stock aggregates are not prevented from mixing with soil substances of storage areas. Also, aggregates from different gradation levels mix each other.

The Effect of Outside Weather

Aggregates are get wet due to the effect of outside weather conditions such as rain and snow. When aggregates contact with water and moisture, they usually tend to absorb water and keep it inside since they have a large surface area to contact with thus leading a decrease in the quality of asphalt produced because water oxidizes metal molecules inside the aggregates and asphalt produced from oxidized aggregates is poor in quality.

The Effect of Dust Particles Sticking to Aggregates

When aggregates are get wet, they become more prone to surrounded by dust particles which, during transport and carrying of aggregates with conveyors, are thoroughly adhere to the surface of aggregate and form an outer shell which do not come off easily even during the drying stage of aggregates inside the dryer and stay at the surface of large aggregate particles. This situation prevents homogenous mixing of aggregates with bitumen during asphalt production because this outer shell later dries forming a film layer over aggregates thus preventing it from making a homogenous mixture with bitumen so the result is poor quality asphalt formation.

Dusting Effect During Transfer, Loading and Discharge of Aggregates

While aggregates are transferred from crusher unit either to storage areas or to asphalt plant, they are loaded and discharged several times causing a significant amount of dust to form. Lorries are generally used to transfer aggregates from one place to another at short distances and during transfer to cover aggregates with a canvas sheet is not a routine application. As a result, dusting during loading and discharge of aggregates has the same effect with dusting which forms at crushing unit and it only contributes the situation.

Effect of Environment

Noise which result from transfer, screening, loading and discharge activities of aggregate together with energy-emission have inversely effect the environment and people working in the area. Also, the maintenance costs for the equipments used for this purpose both increases the overall investment and also reduces the productivity.

Effect of Energy Wasted During Drying of Aggregates

In order to achieve a homogenous mixture of aggregate and bitumen which is at the required quality during asphalt production, the whole mass of aggregates should be dried at dryer oven which is heated up to 160 C. Aggregates stored and kept at open areas are get wet and thus contain a significant amount of water inside which should be first evaporated to effectively dry aggregates. Heat energy required for heating of wet and humidified aggregates constitutes an important item with respect to energy and investment costs of the procedure. Another consequence of high energy consumption during heating and drying of humidified aggregates is the increased exhaust gases emission values which is the result of using high amount of fuel at drying stage.

Another undesired effect of high water content of aggregates is the water vapor which forms as a result of hot air released through dryer oven's chimney. Since the water vapor contained inside the hot gases released from chimney gets a muddy appearance together with dust on dust trapping filters and clogs on the meshes thus decreasing filter's permeability and work performance. A clogged filter bag keeps air fans to absorb to air properly. Under these circumstances, the amount of oxygen required for efficient burning of fuel used in dryer burner is not supplied sufficiently as a result dryer capacity is decreased and unburned gases diffuse atmosphere.

On the other hand, when aggregates are crushed, heat energy is formed due to friction between aggregate surfaces and this energy enables a significant amount of water vapor to evaporate. However, due to temperature loss of aggregate material deposited at places open to atmosphere, humidification re-occurs and energy created during friction is wasted.

The Effect of Utilizing Micro Granulated Dust Particles in Production

Dust is formed in two ways in an asphalt plant:

1. as a result of crushing, screening and transfer processes of aggregates in crusher unit, after loading and discharge of aggregates at storage areas and at the end of drying, screening and carrying processes of aggregates in asphalt plant,
2. micro granulated particles separated from aggregate itself.

Micro granulated dust particles are not only a fundamental element for the quality of asphalt produced but also an important raw material for other industrial sectors such as pharmaceutical, cosmetics, chemical and dye industry. If granulated dust particles can be obtained in substantial amounts after above described processes, they can be both used in asphalt plant as quality enhancer and as raw material for other industrial sectors. However, for some of the abovementioned reasons such as the localization of crusher units in wide areas, their open system operation, wide storage places which make the control of dust formation difficult, a great portion of dust formed is also get lost. In this case, some industrial sectors encounter with the loss of an important raw material and meet this requirement by applying some special production processes which are high in cost or import it. So, the industrial contribution of this material is underestimated. This situation is further increasing the importance of collecting micro granulated dust particles without letting them spread to the environment. Nevertheless, to collect even a tiny amount of particles before they dispense through the surrounding in conventional open, horizontal displacement areas where usually equipment and machinery are dispersed is difficult and requires the implementation of a highly complex dust absorption system which is more expensive than the plant itself.

Although the social awareness and enforcements for environmental pollution have been raised, the alternatives to the conventional system are not practical for most of the companies.

The Effect on the Quantity of Bitumen and Asphalt Quality

The quantity of aggregates that should be contained in asphalt mixture and the proportion of bitumen are two critical factors which are determined by technical calculations and based on laboratorial tests and experiments according to the purpose of using asphalt, its strength and the type of aggregate. The less proportion or high proportion of aggregate in asphalt mixture directly affects the quality of asphalt. The amount of bitumen less than the required prevents aggregates to stick well each other on the other hand amount which is higher than the required lessens the strength and usage life of asphalt and causes deformation in a short period. Therefore, the correct proportion of bitumen inside asphalt mixture should be carefully calculated, controlled and maintained at optimum levels for quality asphalt production.

However, in conventional open, horizontal displacement plant areas where soil and foreign substances easily mixed with aggregate can not be effectively removed, the amount of bitumen which is higher than the required amount is used because soil and foreign substances form a thin layer around aggregate so that bitumen absorption by aggregates is made difficult. Improved bitumen absorption is only accomplished when the amount of bitumen is higher than the required amount. In this case, too much bitumen decreases the quality of asphalt. On the other hand, bitumen being a by-product of petroleum is the high cost entry within expense items so the increase in its amount is undesirable with respect to production costs.

The Effect on Asphalt Production Cost

As it has been explained in above paragraphs, despite all these unfavorable conditions and regardless of the type and number of crushing and screening stages as well as the processes applied in conventional open, horizontal displacement plant areas which currently prevail, control and prevention of unwanted mixing of aggregates with soil and foreign substances can not be accomplished. Since the asphalt is produced from aggregates which can not be separated from impurities and changed into ballast form and low quality asphalt is obtained at a higher cost.

This invention which has been explained in the following section, offers a new way to eliminate or at least minimize all the disadvantages of the present system by providing an industrially applicable, improved system and procedure for producing high quality asphalt at a lower cost.

BRIEF SUMMARY OF THE INVENTION

The object of the invention is to provide a method for using soil-free aggregates in asphalt production by producing ballast material from hard stones later processing it to eliminate others.

Another object of the invention is to provide a system to eliminate unnecessary investment costs required for the collection of micro granulated dust particles which appear during asphalt production or crushing processes.

It is still another object of the invention is to provide means for the storage of ballast materials before they are brought to final gradation. By this way, we can;

- reduce the storage costs because we can eliminate the necessary production requirement for producing the highest amount of aggregates that will be needed for asphalt production,
- remove the harmful effect of oxidation of metal molecules caused by humidification of aggregates,
- reduce the requirement for storage areas,
- reduce the harmful environmental effect by preventing the dissemination of micro granulated dust particles,
- create more healthy working environment for people at plant,
- remove the dusting effect which forms during transfer, loading and discharge of aggregates,
- stop the noise which results during transfer, screening, discharge and loading procedures of aggregates and terminate the harmful effects of energy emitted during operation of equipment in above procedures,
- reduce the repair and maintenance costs of equipments used in above procedures and prevent the reasons which can hinder production and reduce the production capacity,
- prevent the mixing of aggregates with foreign particles such as soil and other impurities.

Another object of the invention is to provide a system to make use of micro granulated dust particles as raw material in other industrial applications.

Another object of the invention is to prevent micro granulated dust particles from sticking on the surface of aggregates forming an uninterrupted film layer which later on inhibits a homogenous mixture formation between aggregates and bitumen.

Another object of the invention is to reduce the energy requirement and consequently decrease investment costs.

Another object of the invention is to prevent using too much fuel consequently decrease chimney gas emission values.

Another object of the invention is to prevent water vapor released with hot air from exhaust pipe to adhere on the surface of dust retarding filters and consequently remove any unwanted effect which will hinder the filter's function.

Another object of the invention is to prevent the decrease in dryer's capacity and diffusion of unburned gases to the atmosphere.

Another object of the invention is to decrease the energy requirement of dryer oven by preventing the humidification of aggregates which have been already heated and dried with the effect of heat energy forming as a result of friction between aggregate surfaces.

Another object of the invention is to make possible the use of micro granulated dust particles as raw material for other industrial applications in such as pharmaceutical, cosmetics dye and chemical industries.

Another object of the invention is to increase the quality of asphalt by providing a better homogenization of aggregate and bitumen.

Another object of the invention is to decrease cost and increase asphalt quality through optimum utilization of bitumen.

Another object of the invention is to provide a continuous feeding of asphalt plant by storing aggregates at different gradations in the same closed system.

Another object of the invention is to provide the exact quantity of aggregates required by production just in time owing to the advantage of continuous feeding of asphalt plant which provides the adjustment of crusher's revolution speed.

Another object of the invention is to provide a mechanism for feeding of more than one asphalt plant accomplishing plenty numbers of transfers and feedings of aggregates each at different axis under the new mechanism.

Another object of the invention is, when necessary, to provide a mechanism for direct discharge of aggregates into the vehicles accomplishing plenty numbers of transfers and feedings of aggregates each at different axis under the new mechanism.

Another object of the invention is to provide a mechanism for the storage of aggregates at more than one gradation category and to alter storage capacities according to requirement of asphalt plant.

Another object of the invention is to provide a mechanism for the storage and collection of dust particles through direct absorption from plant units owing to a completely covered operation after secondary crushing stage. The abovementioned mechanism constructed within the context of present invention is generally consist of a frame body within which aggregate material from secondary crusher is contained in circular compartments and foot which support the body.

Screens are positioned at the upper site of the area where aggregates are entered into the mechanism hence aggregates at the required gradation category are deposited inside the body.

Direction flow of aggregates toward respective circular compartments according to their gradation level is accomplished with directing channels.

Homogenous distribution and storage of aggregates at various places within the body through circular compartments and easy passage of aggregates with directing channels between compartments are accomplished. Horizontal passage corridors between circular compartments provide a means for the utilization of circular compartments as one complete compartment.

The lower ends of circular compartments are designed in conical form for a convenient release of aggregates during asphalt production

BRIEF DESCRIPTION OF THE SEVERAL VIEWS OF DRAWINGS

In order to comprehend the present invention together with its whole auxiliary elements, following illustrations should be evaluated as a complementary part of the invention FIG. 1—illustrates a stone quarry settlement order as a part of present practice.

FIG. 2—illustrates crusher plant settlement order arranged according to present settlement criteria.

FIG. 3—illustrates aggregate storage areas arranged according to present settlement criteria.

FIG. 4—illustrates asphalt plant settlement order arranged according to present settlement criteria.

Figure 5:
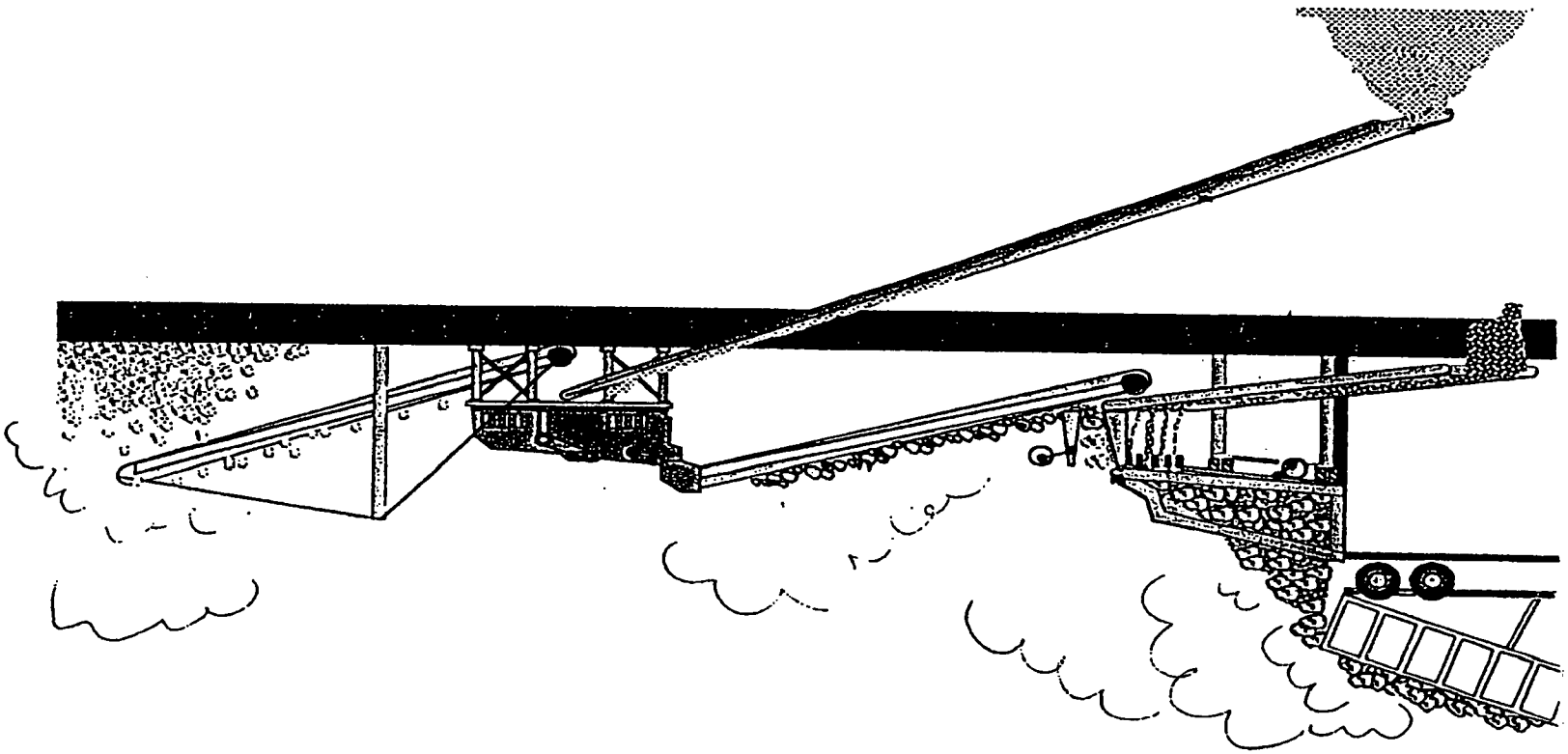

FIG. 5—illustrates crusher plant settlement order arranged according to present invention.

Figure 6:
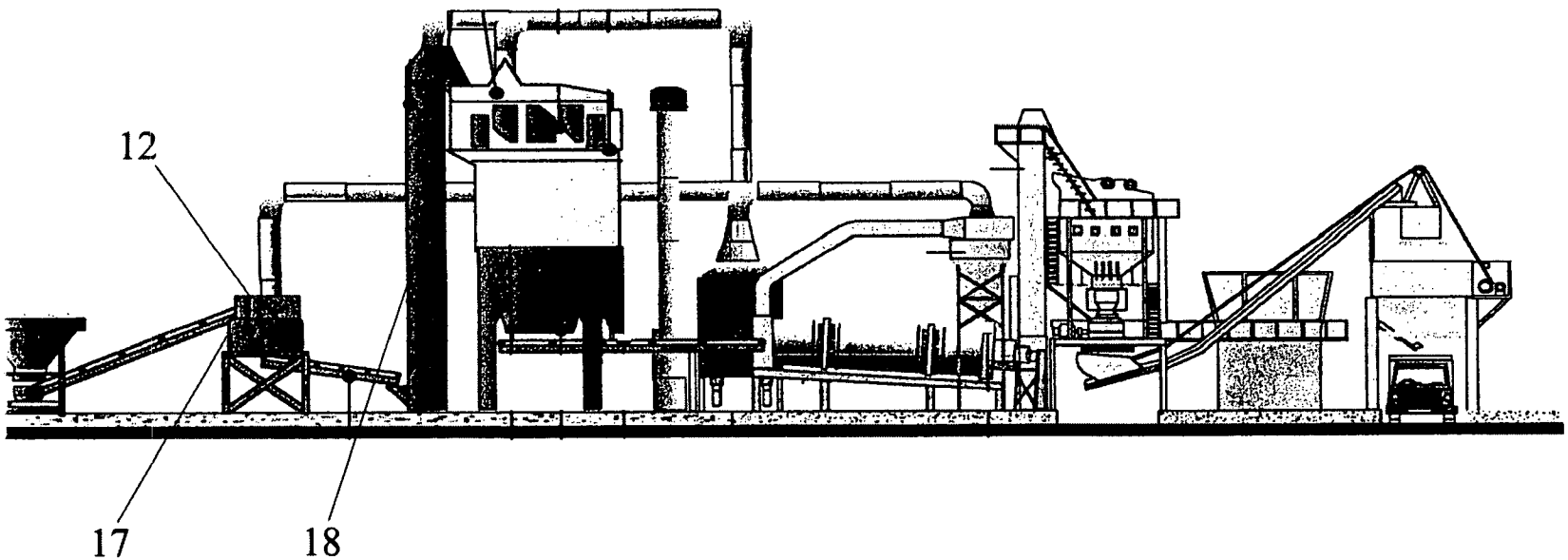

FIG. 6—illustrates asphalt plant settlement order arranged according to present invention.

Figure 7:
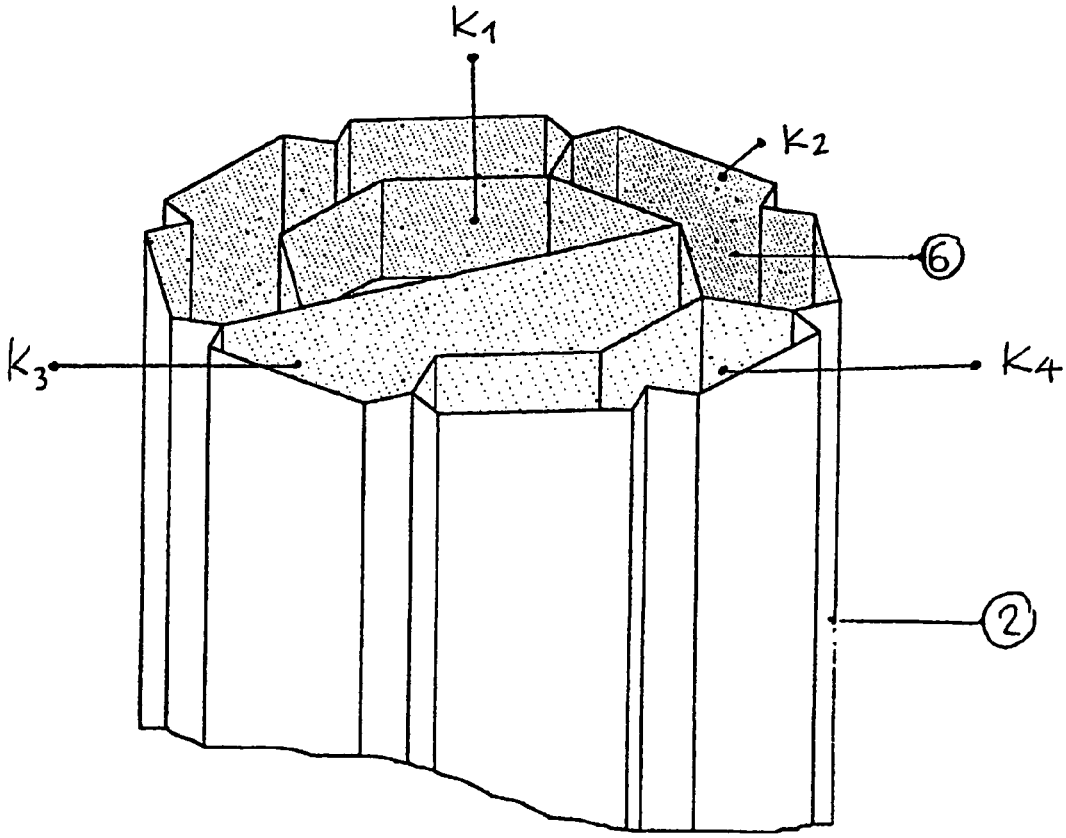

FIG. 7—Perspective illustration of a sectional structure of aggregate classification and storing sections according to present invention.

Figure 8:
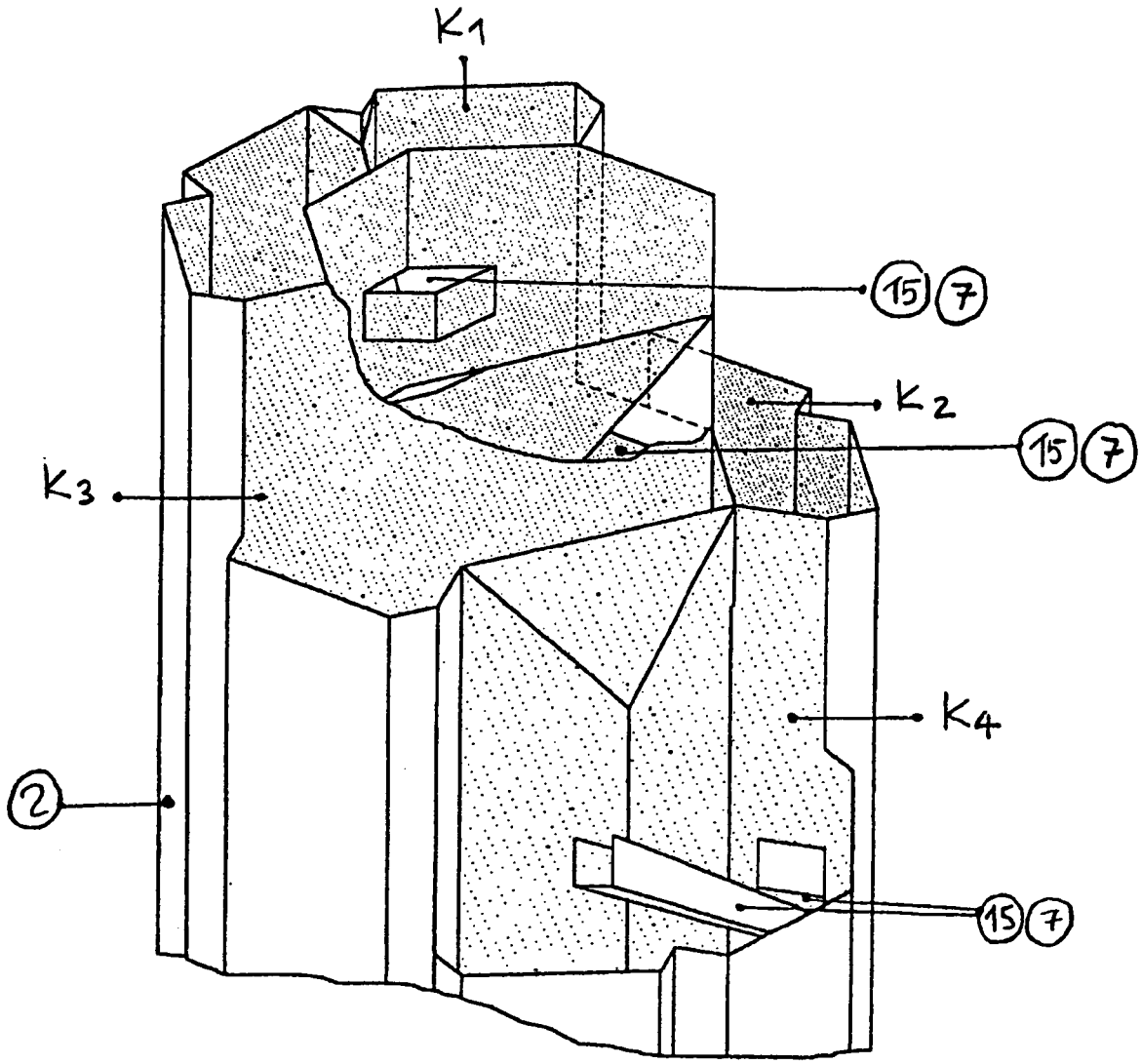

FIG. 8—illustrates a cross sectional view of aggregate classification and storing sections for indicating how distinctly graded aggregates are classified and distributed at different ranges.

Figure 9:
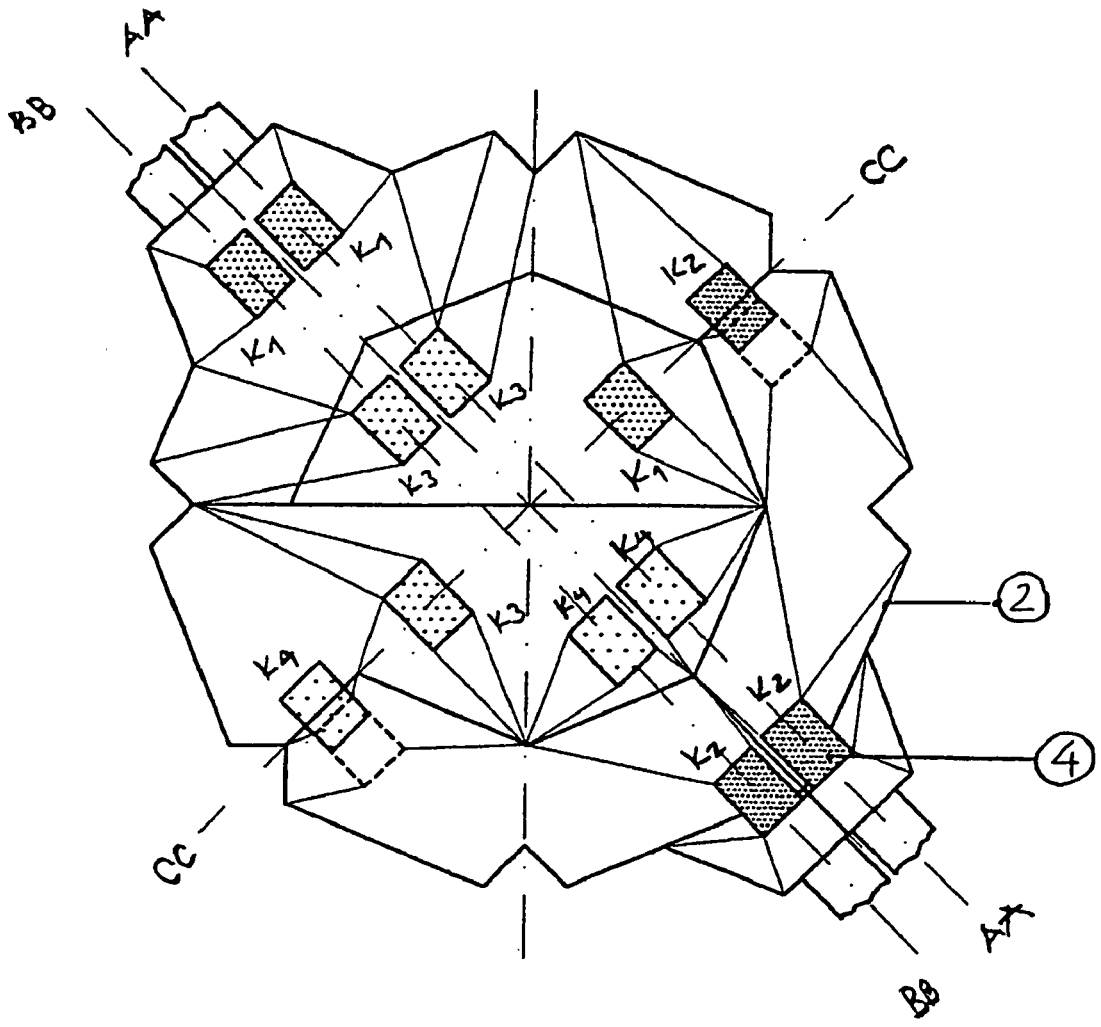

FIG. 9—illustrates schematic view of how aggregate discharge covers are aligned and oriented with conical structure of aggregate classification and storing sections designed at lower part according to the present invention.

Figure 10:
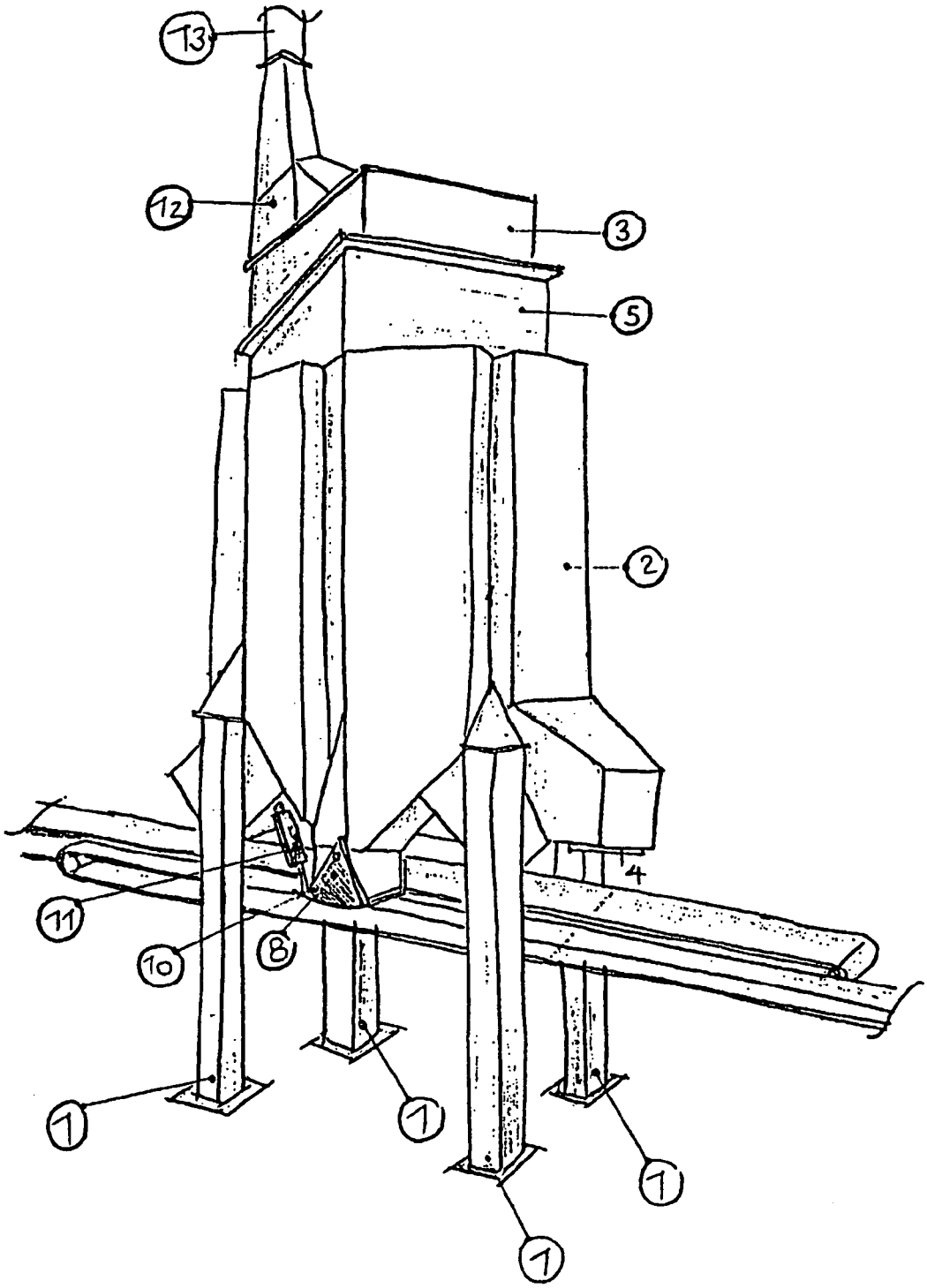

FIG. 10—illustrates a perspective view of aggregate classification and storing sections arranged according to present invention.

Figure 11:
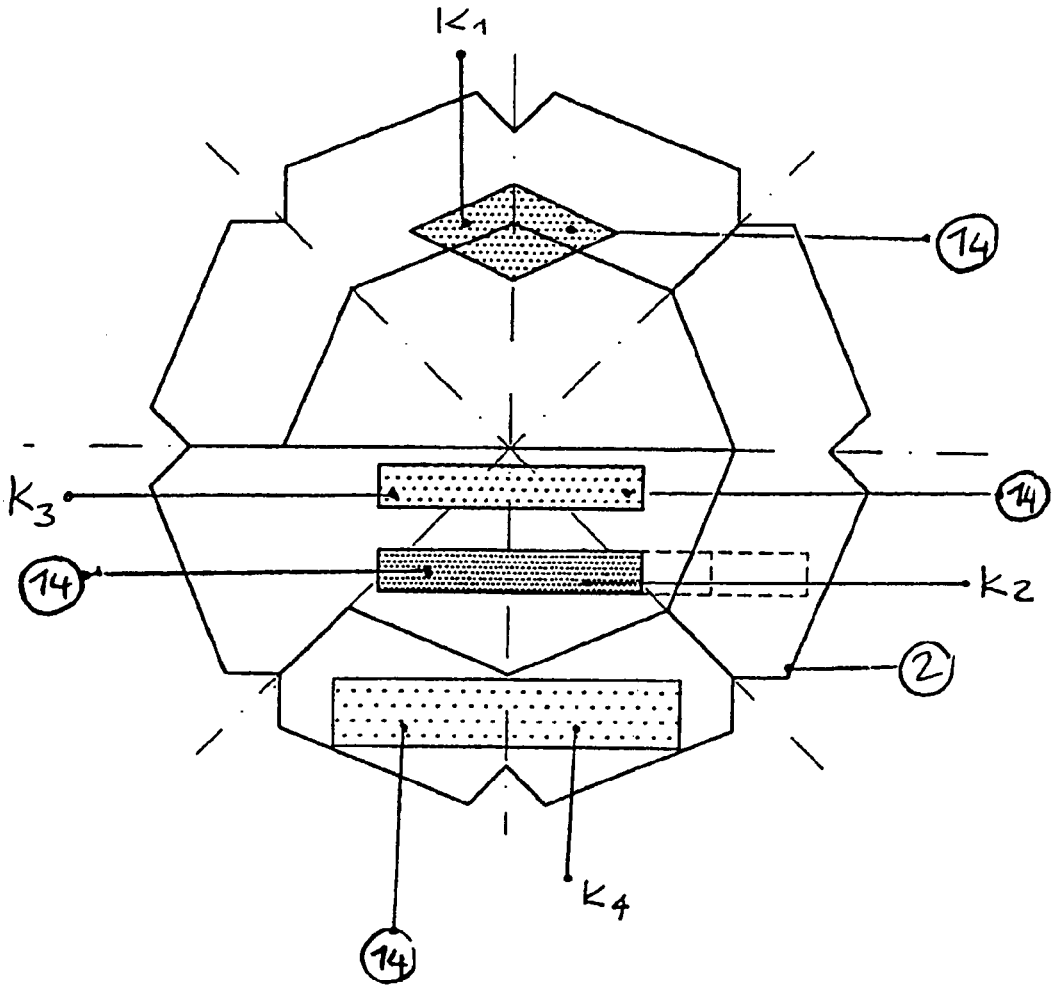

FIG. 11—illustrates structure of aggregate filling covers arranged according to present invention where aggregates coming from screens are oriented towards the body of the mechanism via directing channels.

Figure 12:
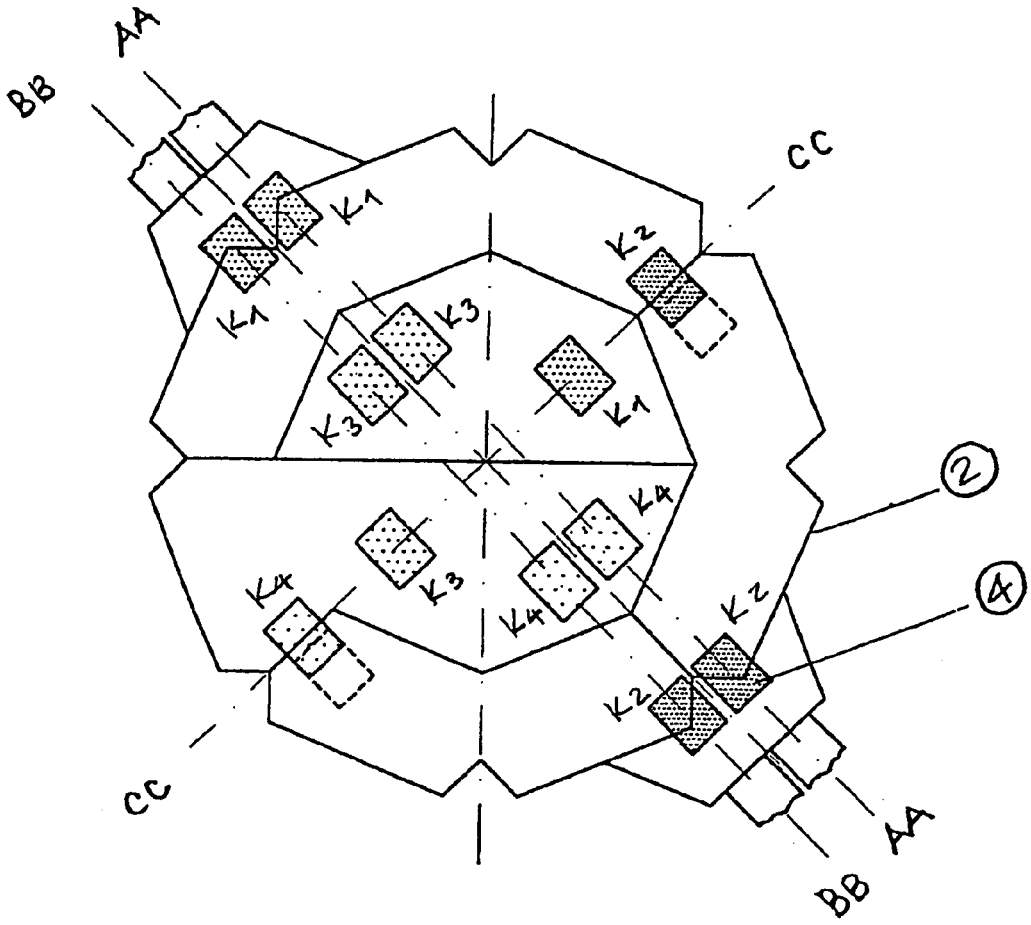

FIG. 12—illustrates schematically of how more than one aggregate discharge covers are aligned at more than one axis arranged according to present invention.

REFERENCE NUMBERS OF PARTS GIVEN AT EACH ILLUSTRATION

1 Foot
2 Body
3 Screen
4 Discharge mouths
5 Directing part
6 Circular sections (segments)
7 Corridors
8 Covers
9 Lower body surface
10 Outer surface of body
11 Piston
12 Paddle box
13 Dust suction pipes
14 Filling mouths
15 Channels
16 Flow mouth
17. Secondary crusher
18. Elevator

DETAILED DESCRIPTION OF THE INVENTION

This mechanism constructed within the context of present invention functions in a general scheme of the processes outlined below:

Quarry material which generally contains soil and large and coarse stone particles is firstly crushed in primary crusher and treated to eliminate its foreign particles by by-pass system.

Crushed material is carried into sieving unit via conveyors, screens through them and classified according to their sizes. Ballast material with 25–65 mm particles sizes are separated from others in sieving unit and deposited in open storage areas for further use in asphalt production. Other classified group of materials are carried via conveyors to open areas and utilized as high quality filler material which is required for asphalt production.

Therefore, ballast material deposited at open areas before they are crushed to bring them into required particle sizes are being subject to harmful effects of storage at open places.

By using the mechanism constructed within the context of our present invention, ballast material deposited at open storage areas for asphalt production are transferred into the cold aggregate bunkers (silos).

Ballast materials which have been removed from impurities are crushed in secondary crusher (17) and are directly transferred via conveyors and closed form vertical elevators (18) into the screens located on the constructed mechanism.

The crushing revolution of the secondary crusher as well as the speed, flow rate and crushing sizes of ballast material can be adjusted according to the gradation level of aggregates required in asphalt production. As a consequence, only the sufficient amount of aggregates can be obtained as required by asphalt production which is subject to variable gradation levels throughout the production.

The required and obtained amounts of aggregates can be balanced through this mechanism which removes the need for making a production planning to determine the exact required amount for asphalt production.

The aggregate material discharging from the secondary crusher is fed into a vertical elevator (18) having closed from structure through conveyor belts and then the aggregate material is sieved in proportion to gradation rates required by asphalt production by vibrating screens (3) located on the constructed mechanism and then classified. The vibrating screens, like the body (2) and the elevator, have completely closed-form structure and are in association with a filter system for sucking dust volume caused by crushing the aggregate.

Screen (3) is located at the top of the body (2) where aggregates are entered into the body (2) thus after sieving, aggregate material can freely fall down and fill the store body (2). Aggregates are directed towards their respective circular sections inside the store body based on their gradation rates with the help of directing parts.

There are plurality of circular sections placed inside and in a manner of surrounding the storing body (2) for the homogenous storage of different category aggregates [K1 (4–7 mm), K3 (7–12 mm), K4 (12–19 mm)] by dispersing them through sections.

As it is seen in FIGS. 7 and 8, there are channels (15) and corridors (7) between circular sections (6). The channels (15) and corridors (7) are disposed as tree branch-like manner in the body (2) and they provide flow of aggregates in the direction of discharge mouths (4) without disturbing their homogenization during this flow. They can also provide the utilization of all of the plurality of circular sections (6) in the form of a single section when it is required i.e. requirement with regard to volume of aggregate and the number of gradation.

The base segment of the constructed mechanism is given a conical construction for free fall of deposited and classified aggregates to enable them to go towards the discharge mouths (4).

In FIG. 10, aggregate classification and storing sections according to present invention are shown. Sections comprise one main body (2) within which aggregates are deposited and a foot (1) component which support body and connect it to the ground.

The certain features of invented mechanism for instance the number of foot (1) and storing sections (6), the capacity of body, the number of different gradations and means 17 of access between sections can be altered as to feed the aggregate requirement of the asphalt plant or modifications on the present mechanism can be added afterwards.

In FIG. 10, aggregates are sieved passing through screens (3) positioned at the top of the new closed system mechanism in order to be classified according their gradation rates.

Thus sieved and classified aggregates are sent to the sections (6) arranged in a circular manner within the body (2) by directing parts (5) which direct the flow of aggregates.

After the aggregates have been entered to the main body (2) via filling mouths (14) that are arranged on the upper side of the body (2), they are directed into the sections (6) as free fall under the influence of gravity, as it is seen in FIGS. 11 and 8.

Since the capacities of each storing sections is varied in order to properly arrange the deposition of more than one graded series of aggregates at various quantities, the number of sections (6) which will be constructed within the body (2) is determined to match each categories of aggregates. These storing sections (7), corridors (15) and channels also render a balanced distribution and storage of aggregates within the body.

Moreover, it is also being possible to chance the number of gradations and storage capacities by giving a new form to storing sections in order to accommodate with the changes in aggregate requirement over time. One more advantage of circular sections within the body is that a full body is used to control the center of gravity.

Within the context of present invention, the body has been constructed in view of operational conveniences in both production and assembly of the invented mechanism. Storing sections (6) which are in circular form have been symmetrically arranged within the body (2) but upon the requirement, more than one circular section can be united by constructing horizontal passages (7) (15) to form a unique single storing section. This has been shown in FIG. 9.

Aggregate material are freely discharged from the top and allowed to store circular sections within the body with its free fall. Channels and corridors between sections are branched to provide a homogenous distribution within the sections. This has also been shown in FIGS. 11 and 8. These channels provide material flow from one section to the other at different levels. Accordingly, when the material level is increased inside the silo, aggregate freely move between these channels thus making it possible to maintain a steady material level without disturbing the homogenization. Heavy aggregate particles are kept from falling at the bottom.

Aggregates which are continuously sieved at top screens fill the sections by passing through channels and corridors and keeping their filling level and homogenous formation. When they reach at discharge mouth (4), discharge covers (8) are opened up easily with weight of aggregates allowing aggregates to discharge homogenously and continuously for feeding the conveyors placed under the body (2) for conveying to thereof to the asphalt plant.

This mechanism works under completely closed system to allow for the classification, storage and continuous feeding of asphalt plant and dust forming through above processes is absorbed and collected with the help of a paddle box (12) as well as dust absorbing pipes (13). With this method, dust is not allowed to spread to environment instead collected without undergoing much loss of quantity and the requirement for micro granulated dust particles also called filler material in asphalt production is met.

According to FIG. 12, the lower sides of each storing section (6) were given a conical shape to allow for the collected aggregates to freely flow down to the conveying vehicle. Under each storing sections, there are discharge mouths (4) separately designed for each category of gradations such as K1(0–4 mm), K2(4–7 mm), K3(7–12 mm), K4(12–19 mm).

For each category of gradations, more than one discharge mouth on more than one axis can be operated and the number of discharge mouths can be determined according to the aggregate feeding requirement of asphalt plant. The shape and dimensions of the lower surfaces of the body are also determined depending on the number and dimensions of discharge mouths.

The body's outer edges (10) which have been shaped in the form of a cone are connected with the lower surface (9) and the body itself (2) by ignoring the main body structure when it seems necessary (FIG. 10).

As it is seen in FIG. 12, the cover openings of discharge mouths (4) (the gap which forms when the cover (8) is opened to release aggregates) of each storing sections which belong to each category of gradations and situated at the lower surface of the body (9) in the direction of different axis can be adjusted as to discharge the exact quantity of aggregates. Discharge mouth cover (8) openings (10) can be adjusted with hydraulic pistons (11) connected to a control system which operates either mechanically or electronically depending on request.

As it is seen in FIG. 12, it can be accomplished through discharge mouths (4) situated in duplicate on the same axis to feed more than one asphalt plant placed either in parallel or in different directions on (AA) and (BB) axis. This also enables a more flexible usage of production capacity or only a 50% reduction in capacity of instead of completely shutdown production when there is a breakdown in one plant because the other plant can be operated at 50% capacity by means of supplementary feeding on different axis.

For continuous feeding of asphalt plant, discharge of material can be accomplished through discharge mouths (4) which directly pour the material onto the conveyor unit or conveyor is brought to suitable sizes as to enable it to discharge aggregates into a carrying vehicle placed under the body. Height of conveyor from the vehicle and distance between conveyor feet are accordingly arranged to accomplish direct loading of carrying vehicle which comes between conveyor feet.

Another aspect of the present invention is to have the method steps for providing classification and storage of aggregates and comprising the following sequences;

- crushing of ballast material in secondary crusher (17) which is covered with the paddle box (12) and connected to a filter system for the absorption of dust,
- controlled crushing through which aggregate flow rate, flow speed, gradations and the amount of each gradation are managed with modifications made on the revolution speed of the secondary crusher (17),
- transferring of aggregate material to the closed vertical elevator (18) which is connected to filter system for the absorption of dust,
- transferring of aggregates in a vertical position with the vertical elevator (18) to screens (3) of the mechanism,
- sieving of aggregate material with screens (3) which are covered with the paddle box (12) and connected to a filter system for the absorption of dust,
- directing the flow of aggregates towards inside the mechanism using directing parts and delivering aggregates into storing sections with respect to their gradations,
- storing of more than one size (gradation) of aggregates in a completely closed system, storing of more than one size (gradation) of aggregates by changing (either increasing or decreasing) their quantity when it is required, absorbing and storing of dust particles which form after secondary crushing without causing them to spread to the environment, direct discharging or discharging through feeding system (mule system) of deposited materials from discharge mouths (4) either manually or by automatic control, placing of horizontal conveyor bands which can make aggregate transfer in more than one axis under the mechanism, placing plurality of discharge mouths (4) along with the same axis for enabling feeding of various conveyors of the asphalt plants situated at two or more different directions.

The invention claimed is:

1. An apparatus for separating and storing gradations of crushed aggregate, said apparatus comprising:

a storage body comprising a plurality of vertically extending storage sections;

means situated above said storage body for receiving crushed aggregate;

means for separating the received crushed aggregate into different gradations means for directing the gradations of separated crushed aggregate into different ones of said storage sections;

means situated proximate the bottom of said storage body for discharging the crushed aggregate from said storage sections;

corridor means; and channel means situated within said storage body between said storage sections for connecting said storage sections with said discharge means, said apparatus being enclosed so as to prevent the escape of micro granulated particles to the environment, wherein said corridor means and said channel means extend horizontally to connect said storage sections.

2. An apparatus for separating and storing gradations of crushed aggregate, said apparatus comprising:

a storage body comprising a plurality of vertically extending storage sections;

means situated above said storage body for receiving crushed aggregate;

means for separating the received crushed aggregate into different gradations means for directing the gradations of separated crushed aggregate into different ones of said storage sections;

means situated proximate the bottom of said storage body for discharging the crushed aggregate from said storage sections;

corridor means; and channel means situated within said storage body between said storage sections for connecting said storage sections with said discharge means, said apparatus being enclosed so as to prevent the escape of micro granulated particles to the environment, further comprising suction means for removing particles from said apparatus.

3. The apparatus of claim 1 or 2 further comprising means for supporting said body with said discharge means spaced from the ground.

4. The apparatus of claim 3 further comprising conveyor means extending under said body in alignment with said discharge means.

5. The apparatus of claim 1 or 2 wherein said discharge means comprises a plurality of discharge openings and means for covering said discharge openings.

6. The apparatus of claim 5 further comprising means for automatically opening said covering means.

7. The apparatus of claim 1 or 2 wherein said separating means comprises vibrating screen means.

8. The apparatus of claim 1 or 2 further comprising elevator means for conveying crushed aggregate to said receiving means.

9. The apparatus of claim 1 or 2 further comprising elevator means for conveying the crushed aggregate to said receiving means.

10. The apparatus of claim 2 further comprising elevator means for conveying crushed aggregate to said receiving means, wherein said suction means removes particles from said elevator means.

11. The apparatus of claim 2 further comprising elevator means for conveying crushed aggregate to said receiving means and filter means in said suction means.

* * * * *